US006507277B2

(12) United States Patent
Röpke

(10) Patent No.: US 6,507,277 B2
(45) Date of Patent: Jan. 14, 2003

(54) DANGER SIGNALLING SYSTEM

(75) Inventor: Gerhard Röpke, Lübeck-Travemünde (DE)

(73) Assignee: Job Lizenz GmbH & Co. KG, Ahrensburg (DE)

( * ) Notice: Subject to any disclaimer, the term of this patent is extended or adjusted under 35 U.S.C. 154(b) by 0 days.

(21) Appl. No.: 09/975,439

(22) Filed: Oct. 10, 2001

(65) Prior Publication Data

US 2002/0057198 A1 May 16, 2002

(30) Foreign Application Priority Data

Oct. 10, 2000 (DE) ..... 100 51 329

(51) Int. Cl.[7] ..... G08B 29/00

(52) U.S. Cl. ..... 340/514; 340/506; 340/511; 340/531; 340/533; 340/3.1

(58) Field of Search ..... 340/514, 511, 340/513, 539, 573.1, 531, 533, 31; 370/248, 252, 400

(56) References Cited

U.S. PATENT DOCUMENTS

| | | | | | |
|---|---|---|---|---|---|
| 3,797,008 | A | | 3/1974 | Yuasa | 340/227 |
| 5,045,787 | A | | 9/1991 | Auer, Jr. et al. | 324/217 |
| 5,544,154 | A | * | 8/1996 | Glitho | 370/248 |
| 5,553,058 | A | * | 9/1996 | Glitho | 370/248 |
| 5,583,848 | A | * | 12/1996 | Glitho | 370/248 |
| 5,608,644 | A | * | 3/1997 | Debacker | 702/122 |
| 5,638,357 | A | * | 6/1997 | Glitho et al. | 370/250 |
| 5,680,054 | A | * | 10/1997 | Gauthier | 324/713 |
| 5,872,823 | A | * | 2/1999 | Sutton | 375/372 |
| 6,150,936 | A | | 11/2000 | Addy | |
| 6,185,191 | B1 | * | 2/2001 | Dipperstein | 370/249 |
| 6,195,395 | B1 | * | 2/2001 | Frodsham | 375/257 |
| 6,342,836 | B2 | * | 1/2002 | Zimmerman | 340/571 |

FOREIGN PATENT DOCUMENTS

| | | |
|---|---|---|
| EP | 0 191 239 | 3/1990 |
| EP | 0 874 341 | 10/1998 |
| EP | 0 572 204 | 8/2000 |
| GB | 2127603 | 4/1984 |

* cited by examiner

*Primary Examiner*—Daryl Pope
(74) *Attorney, Agent, or Firm*—Vidas, Arrett & Steinkraus, P.A.

(57) ABSTRACT

A danger signalling system, including a multiplicity of detectors (M1 to $M_n$) and other line members, in case of need, which respond to at least one danger criterion and are connected to a two-wire line (line A), a control centre connected to the line (line A), which has a voltage supply and a central processor in which the addresses of the detectors are stored for individually addressing and polling the detectors as well as a program for monitoring the status of the detectors. A testing circuitry is disposed in the control centre for checking the working order of the network formed from the line and the detectors or line members by means of a testing unit wherein the testing circuitry includes a testing processor which, in turn, has an evaluation software, and a switch assembly controlled by the testing processor is provided for selectively connecting the at least one testing unit to the line (line A).

19 Claims, 2 Drawing Sheets

DANGER SIGNALLING SYSTEM

BACKGROUND OF THE INVENTION

The invention relates to a danger signaling system.

Danger signaling systems, e.g. fire alarm installations, as a rule, include a major number of danger detectors which are connected to a two-wire signaling line. This one may be conceived as a stub-end feeder or a ring circuit via which the individual detectors communicate with a control centre. Each detector has a sensor or the like which, in dependence on parameters in its environment, produces measured values. The values measured are transferred to the control centre through the line where the control centre usually polls the individual detectors cyclically. In order to associate the measured values with the individual detectors, it is necessary to assign an identifier or address to each detector. The address is saved in a non-volatile memory of the detector. The message addresses are stored in the processor of the control centre so that the control centre can monitor the individual detectors by means of a suitable program.

The installation and putting into service of such a danger signaling system involves a considerable expenditure. Installation work is frequently entrusted to companies which cannot be referred to as specialized firms for such systems. As a rule, however, such a signaling system will be put into service by specifically trained personnel. For the aforementioned reasons, there is a need to discover and identify errors and malfunctions, which occur because of faulty installation, as shortly as possible prior to putting the system into service, but not later than during the putting into service.

It is known to provide separate testing circuitries which are connected to the signaling line, e.g. to verify errors causing short-circuits, or any misplacement of poles in the lines.

It is the object of the invention to provide a danger signaling system which enables to identify and localize a multiplicity of errors in a simple way with the expenditure for the test circuit and the expenditure in measurements being minimal.

The invention in various of its embodiment is summarized below. Additional details of the invention and/or additional embodiments of the invention may be found in the Detailed Description of the Invention below.

BRIEF SUMMARY OF THE INVENTION

The inventive danger signaling system provides for a testing circuitry which forms part of the control centre and, for example, checks the working order of the network of the danger signaling system following a particular instruction by the central control processor. This is done by means of at least one testing unit which includes a testing processor of its own in which a test program is stored. Moreover, a switch assembly is provided which is controlled by the testing processor to selectively connect the at least one testing unit to the signaling line.

The inventive danger signaling system integrates the measuring means in the detection control centre to check the working order of the danger signaling system so that errors in installation may be discovered rapidly and efficiently if the system combines with an intelligent evaluation software.

Errors which are frequently encountered in danger signaling systems include misplacements of the wire poles, an excess of admissible line lengths, short-circuits or a physical contact with wires or shielding enclosures as well as a confusion of detector types and deviations from the installation scheme as well as changes to transition resistors.

A particular testing unit may be provided for errors of this type in the testing circuitry with all of the testing units being connected to a testing processor. This one, however, may be provided as a redundant unit.

According to an aspect of the invention, the testing circuitry is designed as a module, e.g. which has the form of a p.c. plug-in card on which all components of the testing circuitry are arranged.

According to an aspect of the invention, the testing circuitry has a modem connection to check the network via a trunk connection line. For example, this one may be realized through the telephone network. If there is such an option it will be possible to set the checking procedure to work from a distant location such as the place where the danger signalling system was manufactured. The results obtained during the check, particularly the errors found, may then be read out and may be transmitted to the distant location through the trunk connection line. Thus, errors in installation may be discovered and remedied, for example, prior to the final putting into service or the final acceptance of the danger signalling system.

It quite frequently occurs that lines of excessive lengths are used in installing a danger signalling system. The result might be that this weakens or disturbs the transmission of signals on the line so that regular operation is no longer ensured. A testing unit for establishing inadmissibly large line lengths provides for a stabilized-current source which is connected to the line via a modulator and a controllable switch. A data word which is produced by the testing processor via a modulator and, in addition, contains the address of a detector may be utilized to address a detector and a switch disposed therein may be caused to interconnect the wires of the line. The stabilized-current source limits the current on the line to a predetermined value and a voltage measuring device can measure the entire voltage drop via the short-circuited portion of the line. Since the voltage drops are known for the detectors located in that portion the voltage drop which is caused by the lines will result from the difference of the voltage drop measured and the sum of voltage drops at the detectors of the portion measured and, if required, a precision resistor through which the stabilized current flows to ground. If the voltage drop which is determined by the line length alone is known the resistance of the line length can be determined as well because the cross-section of the line is known. Thus, the length of the portion measured may also be determined from the resistance thus determined for the lines of the portion measured. The overall length of a line may be determined in this way. Likewise, the above described manner makes it possible to determine the length of line portions between selected detectors by successively closing the cross-connection switches in the detectors that limit the line portion.

According to an aspect of the invention, the data word for addressing the individual detectors and closing the cross-connection switches is preferably of the modulated-voltage type. There are usually a logic circuit and a demodulator in the detector so that the selected or addressed detector establishes the instant at which it is given an instruction to close the cross-connection switch. Furthermore, a timing circuit may be provided which reopens the cross-connection switch after a predetermined time has lapsed in order that the line length may be set up for another portion between detectors.

Lines used for the networks described frequently have a shielding enclosure in the form of a wire braid or a conductive foil which encircles the wires of the lines. Such a shielding enclosure has a very low resistance. It is applied either to ground or a predetermined potential. What might happen particularly in the area of the detectors during installation is that a wire contacts the shielding enclosure, thus provoking a short-circuit. Such a short-circuit may be established by means of the testing unit for a so-called shielding enclosure monitoring. According to the invention, this is done in a simple manner by monitoring the potential of the shielding enclosure via the testing processor. If the potential deviates from a predetermined level there is a contact of a line with the shielding enclosure.

The monitoring circuits described, in part, are of considerable spatial dimensions. Therefore, it is advantageous not only to find out whether there is a short-circuit, but also to locate the location where it is. Hence, an aspect of the invention provides that the shielding enclosure be connected to a potential source via a precision resistor. The testing circuitry has a stabilized-current source as was initially described already. In the case of the short-circuit described, it provides for a predetermined current the level of which is limited to flow through the line, via the short-circuit location, and the precision resistor. The overall voltage drop essentially is composed of the voltage drop in the line portions and at the precision resistor. As was mentioned, the shielding enclosure hardly helps in reducing the voltage and, thus, may be neglected. Since the voltage drop occurring at the precision resistor is known the voltage drop caused by the line may be calculated in this fashion. Likewise, the resistance of the line portion up to the short-circuit location can be determined from the current and the line voltage drop. Since the cross-section and the resistivity of the wires are known the length of the line up to the short-circuit location may thus be calculated from such resistivity. Those calculating operations may be effected in the testing processor.

The length of the line from the control centre to the short-circuit location already is a substantial information which makes it easier to find a short-circuit location. It will be even easier if it can be established between which adjoining detectors a short-circuit has occurred. The length of line sections between the detectors may be determined in the above-described procedure. Hence, if the single line lengths are stored in the testing processor a calculation can be made as to the detectors between which there is a contact between the shielding enclosure and the wire or there is the short-circuit.

The danger signalling systems described frequently employ ring circuits the ends of which are connected to respective symmetrical circuitries of a control centre. Therefore, it is possible to operate a ring circuit from the two ends if it is interrupted, for example, in the area of a short-circuit. In this case, it is possible to operate a stub-end feeder, for example, from one central portion and another stub-end feeder from the other central portion. To allow certain detectors to be removed from the signalling system, one aspect of the invention provides that the detectors have disconnecting switches located in series with the wire to break up the line on either side of a short-circuit location. In normal operation, the disconnecting switches are closed, but will be opened following a instruction from the control centre. Since the control centre "knows" between which detectors there is a short-circuit the detectors adjoining the short-circuit may be addressed to open their disconnecting switches.

The invention will now be explained with reference to circuitries shown in the drawings.

DETAILED DESCRIPTION OF THE INVENTION

Figure 1:
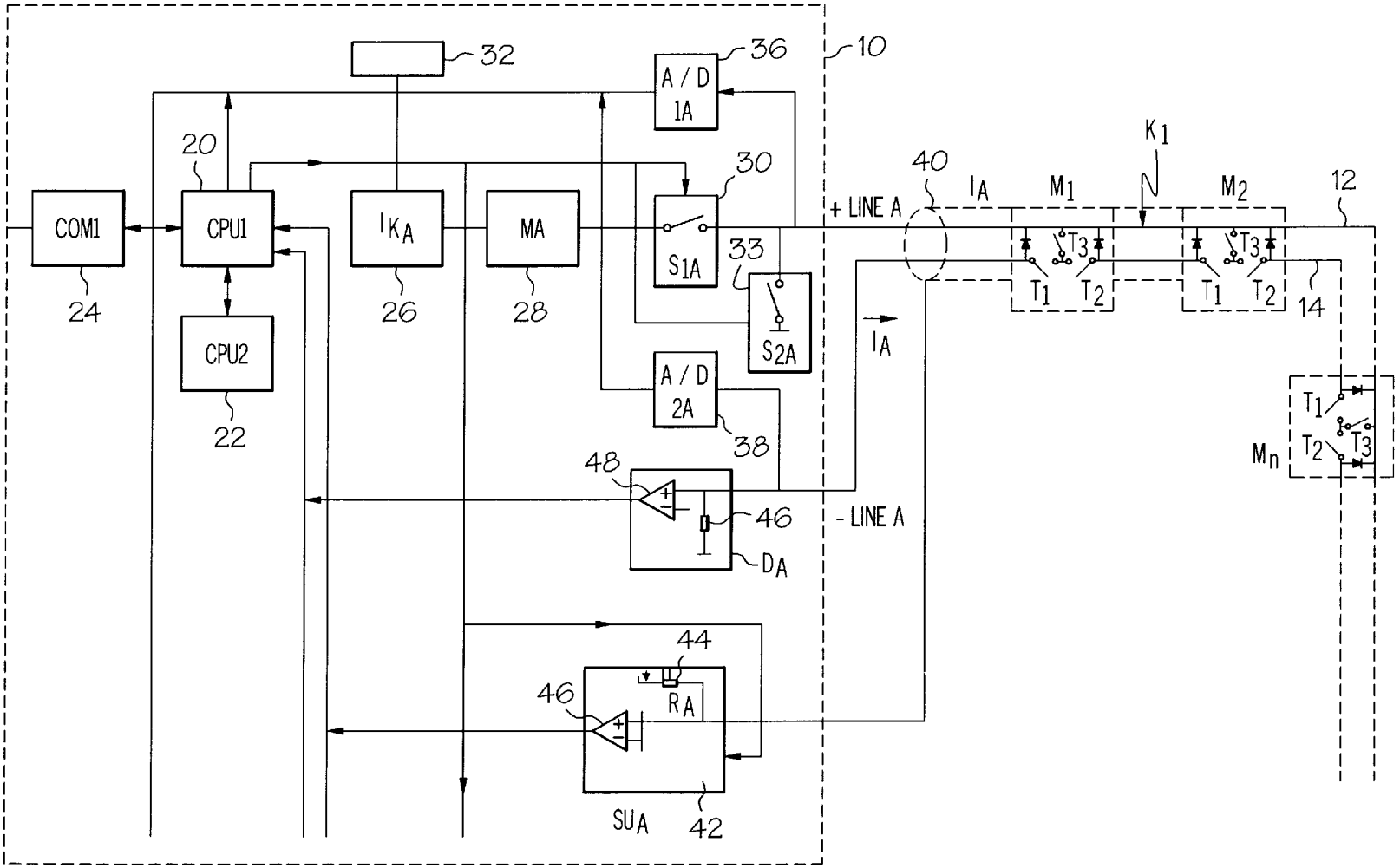
FIG. 1 schematically shows a circuitry of a danger signalling system according to the invention.
Figure 2:
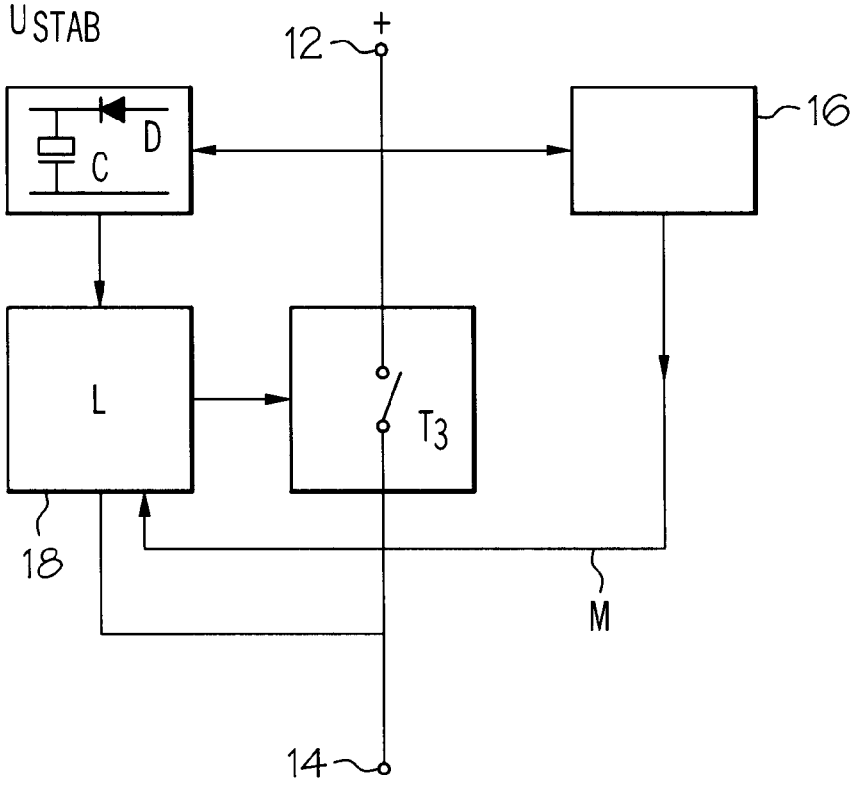
FIG. 2 schematically shows a detector of the danger signalling system of FIG. 1.

While this invention may be embodied in many different forms, there are described in detail herein a specific preferred embodiment of the invention. This description is an exemplification of the principles of the invention and is not intended to limit the invention to the particular embodiment illustrated. Referring to FIG. 1, a testing circuitry is illustrated which is disposed within a box 10 shown in phantom lines. The testing circuitry 10 forms part of a control centre (not shown in detail) of a danger signalling system which has a ring circuit. FIG. 1 only illustrates line A of the ring circuit. The other end which is also connected to both the control centre and a circuitry symmetrical with the testing circuitry 10 is not shown for reasons of simplicity. Line A consists of wires 12 and 14 and a series of detectors M to $M_n$ is connected within line A. FIG. 1 illustrates the detectors M1, M2, and $M_n$. Some part of the circuit comprising the detectors M is depicted in FIG. 2. What can be seen is a cross-connection switch T3 which when closed interconnects the wires 12, 14. What one further sees is the voltage supply $U_{STAB}$ including a capacitor C and a diode D. This supplies the signalling circuit with a voltage even in the case that the voltage of line A drops or nears zero for a short period. The detector M further has a modulator/demodulator 16 which converts a voltage pulse on the line cable into logic signals for a logic circuit 18. The logic circuit 18 incorporates an address memory and several input/output lines. It receives a serial data signal (e.g. an address or instruction) and implements a instruction if the address received coincides with the address stored in the logic circuit 18. For example, this can be the case for an actuation of the cross-connection switch T3, thus short-circuiting the wires 12, 14.

Each detector M has disconnecting switches T1, T2, which normally are closed while the detectors operate, on either side of the cross-connection switch T3 in the core 14. Furthermore, the wires 12, 14 are connected to each other via voltage-regulator diodes which are not referred to in detail so that if there is a misplacement of detector poles during installation a short-circuit will occur which, in turn, can be determined by a short-circuit test, which fact will be referred to farther below.

The testing circuitry 10 has a first testing processor 20 and a second testing processor 20 (CPU 1 and CPU 2, respectively). The testing processor 20 is in communication with the central processor (not shown) of the control centre for the danger signalling system via an interface 24 (COM 1). The testing processor 22 is provided as a redundant unit.

A stabilized-voltage source 26 ($I_{KA}$) is connected to the wire 12 via a modulator 28 (MA) and a switch 30 ($S_{1A}$). The stabilized-voltage source 26 is connected to a voltage supply 32 ($U_{STABA}$). The testing processor 20 controls the modulator 28 and the switch 30 in order to provide a modulated-voltage signal to the line, for example, if the switch 30 is closed. Another switch 33, which is also controlled by the testing processor 20 ($S_{2A}$), connects the wire 12 to ground if it is closed.

A voltage measuring device 36 ($A/D1_A$) is connected to the wire 12 and its output is connected to the testing processor 20. The same applies to a voltage measuring device 38 ($A/D2_A$) which is connected to the wire 14.

Cores 12, 14 are encircled by a shielding enclosure 40 which is outlined in phantom lines in FIG. 1. The shielding enclosure 40 is connected to a shielding enclosure testing unit 42 the output of which is connected to the testing processor 20. It includes a testing resistor 44 ($R_A$) which is connected to the shielding enclosure 40 and to the potential $U_S$, via the other terminal. Furthermore, the shielding enclosure is connected to the positive input of an operational amplifier 46 the output of which is connected to the testing processor 20.

The wire 14 is connected to ground via a precision resistor ($R_{MA}$) with the same pole of the resistor 46*a,* which is connected to the wire 14, being connected to the positive input of an operational amplifier 48 the output of which is switched onto the testing processor 20.

The circuitry shown, for example, allows to determine the line length of line A or the wires 12, 14 and also the line lengths between desired detectors M, e. g. between adjoining detectors M. An embodiment which serves the purpose is described below.

For example, the line length is intended to be measured between detectors M2 and $M_n$. The operational status to start from is a normal one in which the switch 30 is closed and the switch 33 is open. Switches T1 and T2 in the detectors M1 . . . $M_n$ are closed. Switch T3 in the detectors M1 . . . $M_n$ is open. This causes the line (line A) to be brought under a voltage (an operating voltage). A modulated-voltage signal is emitted onto a line, e.g. a ring circuit, by addressing the modulator MA. The data word contains the address of the detector or its communication address and an instruction to close the switch T3, e.g. of $M_n$. After $M_n$ receives the instruction its switch T3 will be closed. Now, a stabilized current $I_A$ will flow, which is caused by the stabilized-current source 26. The current flows through the switches T3 and T1 of $M_n$ and via the resistor $R_{MA}$. The voltage drop is measured at the line A positive connection by means of the voltage measuring device 36 and is fed to the testing processor 20. The voltage drop measured is composed as follows:

1. $U_{RMA}=I_{IKA}\times R_{MA}$
2. $U_{TX}=I_{KA}\times(M_N\times 2\times R_{TX})$
3. $U_{RL}=I_{KA}\times R_L$
4. $U_{LT}=U_{RMA}+U_{RL}+U_{TX}$ where $U_{RMA}$ is the voltage drop across the resistor $R_{MA}$, $U_{TX}$ is the voltage drop across T1, T2 of each detector preceding $M_n$, $U_{LT}$ is the voltage drop at the line connection A, $R_{TX}$ is the overall resistance of all switches T1, T2 of detectors M1 to $M_n$, and $R_{MA}$ is the precision resistance in front of the negative line A connection.

After the members of equation 4 are transposed, what results is:

$$U_{RL}=U_{LT}-U_{RMA}-U_{TX} \tag{1}$$

$$RL(M_n)=\frac{U_{LT}-U_{RMA}-U_{TX}(M_n)}{I_{KA}} \tag{2}$$

Equation 2 is calculated in the testing processor 20 and the result $R_L(M_n)$ is stored. This value incorporates the line resistance between the connection of line A and the detector $M_n$.

After a certain time $t_M$, the switch T3 will be reopened in the detector $M_n$. This is done by means of an appropriate timing circuit which is housed in the detector, e.g. in the logic module 18. The line voltage returns to the operating potential.

Subsequently, the above steps are implemented for the detector M2. The result $R_L$(M2) is also saved in the memory of the testing processor 20. Now, the difference is formed between the two measurements made:

$$\Delta R_L=R_L(M_n)-R_L(M_n)$$

The line length between detectors M2 and $M_n$ can be determined at a given wire diameter (cross-section):

$$l_G=\frac{A\times R_L}{\rho}$$

where A is the cross-section of the line and ρ is the resistivity. The plain length of a wire or wire portion ensues from $$l=\frac{l_G}{2}$$

The same procedure may be applied to determine the overall length of the line. For example, if a ring circuit is contemplated the switch that corresponds to the switch 33 of FIG. 1 will be closed at the other end. This causes a stabilized current to flow to ground via the wire 12. Now, the voltage is measured at the connection of wire 12 via the voltage measuring device 36. The voltage measured may be directly converted into the length of the line:

$$R_L=\frac{U_{LT}}{I_K}$$

$$l=\frac{A\times R_L}{\rho}$$

The values measured for the line portions and the line as a whole may be stored in the testing processor 20.

The circuitry shown may also be an aid in finding a short-circuit between the shielding enclosure 40 and one of the wires as well as the location of the short-circuit.

As mentioned already, the shielding enclosure 40 consists of a wire braid or foil and is of a low resistance and will be neglected in the calculations which follow. Again, the operational status to start from is a normal one, i.e. the switch 30 is closed and the switch 33 is open. Now, the short-circuit K1 and the short-circuit location are to be detected.

The current $I_A$ from the stabilized-current source 26 is flowing. It will flow if the short-circuit K1 exists, even to the potential $U_S$ of the shielding enclosure monitoring device 42 through the shielding enclosure 40 and the resistor 44. The voltage which establishes itself can be measured by means of the voltage measuring device 36. The voltage drop at the resistor 44 is known. Thus, this drop allows to calculate the voltage drop which is provoked through the line up to the short-circuit location K1, i.e. through the wire 12. This voltage drop $U_{LA}$ and the current $I_A$ permit to calculate the wire portion resistance which is denoted as $R_{LK}$. Thus, the line length up to the short-circuit location is:

$$l=\frac{A\times R_{LK}}{\rho}$$

where

A is the cross-section of the wire, $R_{LK}$ is the resistance value measured, and ρ is the resistivity.

In this way, the line distance at which the short-circuit has occurred can be determined. Since this line distance still states little about the real short-circuit location this line length can be correlated with the lengths determined for the line regions between detectors M1 . . . $M_n$. Therefore, it can be readily determined between which detectors the short-circuit is, namely between detectors M1 and M2 here.

In a similar way as described above, it can be established whether there is a misplacement of poles. If the poles are misplaced the stabilized current $I_A$ will flow across the voltage-regulator diode (not shown) and, thus, provokes a short-circuit current which is limited by the stabilized-current source 26. Thus, a measurement of the line length allows to establish the location at which the short-circuit exists. Since the voltage drop at the precision resistance 46*a* will also change in this case the block $D_A$ is capable of determining whether a short-circuit exists or whether the line is undisturbed, which will then result in a respective message to the testing processor 20.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-processing claim other than the specific claim listed in such dependent claim below.

What is claimed is:

1. A method for determining a short-circuit between the line of a danger signalling system and a shielding enclosure for the line, the danger signalling system comprising:

a multiplicity of detectors (M1 to $M_n$) and other line members, in case of need, which respond to at least one danger criterion and are connected to a two-wire line (line A), a control center connected to the line (line A), which has a voltage supply and a central processor in which the addresses of the detectors (M1 to $M_n$) are stored for individually addressing and polling the detectors (M1 to $M_n$) as well as a program for monitoring the status of the detectors (M1 to $M_n$), characterized by the following process steps:

the shielding enclosure is connected to ground via a resistor ($R_A$) of the testing unit, a stabilized-current source ($I_{KA}$) of the testing unit generates a stabilized current ($I_A$) on the line, a voltage measuring device measures the voltage drop at the connection of the line and provides the value measured to the testing processor, the testing processor calculates the resistance of the short-circuited line up to the short-circuit location (K1) and calculates the line length up to the short-circuit location (K1) from the parameters of the line.

2. A danger signaling system, comprising:

a multiplicity of detectors (M1 to $M_n$) and other line members, in case of need, which respond to at least one danger criterion and are connected to a two-wire line (line A), a control center connected to the line (line A), which has a voltage supply and a central processor in which the addresses of the detectors (M1 to $M_n$) are stored for individually addressing and polling the detectors (M1 to $M_n$) as well as a program for monitoring the status of the detectors (M1 to $M_n$), characterized in that a testing circuitry is disposed in the control centre for checking the working order of the network formed from the line (line A) and the detectors (M1 to $M_n$) or line members by means of a testing unit wherein the testing circuitry includes a testing processor which, in turn, has an evaluation software, and a switch assembly controlled by the testing processor is provided for selectively connecting the at least one testing unit to the line (line A).

3. The system according to claim 2, characterized in that the testing circuitry is designed as a module, e.g. in the form of a p.c. plug-in card.

4. The system according to claim 2, characterized in that the testing circuitry has a modem connection for checking the network via a trunk connection line.

5. The system according to claim 2, characterized by a testing unit for checking any respective misplacement of poles of the detectors (M1 to $M_n$) and line members.

6. The system according to claim 2, characterized by a testing unit for checking the line lengths.

7. The system according to claim 2, characterized by a testing unit for checking any respective short-circuits in the line and/or any contact of wires of the line (line A) and the shielding enclosure of the line with a wire.

8. The system according to claim 2, characterized by a testing unit for checking the installed network with a predetermined installation scheme.

9. The system according to claim 6, characterized in that the testing unit has a stabilized-current source which is adapted to be connected to the line (line A) via a modulator and a controllable switch wherein the testing processor and the modulator help in generating a data word which contains the address of a detector (M1 to $M_n$) and a control signal for a cross-connection switch (T3) interconnecting the wires and, further, a voltage measuring device connected to the line (line A) is provided which is connected to the testing processor.

10. The system according to claim 9, characterized in that the data word is formed by modulating the voltage in the modulator.

11. The system according to claim 9, characterized in that a timing circuit is provided which causes the switch (T3) to open.

12. The system according to claim 9, characterized in that at least a second switch is provided which connects a wire of the line (line A) to ground for generating a stabilized current flowing in the line (line A).

13. The system according to claim 7, characterized in that a shielding enclosure testing unit monitors the potential of the shielding enclosure by means of the testing processor and produces a signal if the potential deviates from a predetermined value.

14. The system according to claim 13, characterized in that the shielding enclosure has connected thereto a precision resistor the voltage drop of which is provided to the testing processor and the line resistance up to the short-circuit location is determined from the voltage level at the connection of the line (line A) and the stored voltage drop of the precision resistor ($U_{RA}$) and the line length up to the short-circuit location is determined from said resistance.

15. The system according to claim 2, characterized in that the detectors (M1 to $M_n$) have disconnecting switches (T1, T2) located in series with a wire for breaking up the line (line A) on either side of a short-circuit location (K1).

16. A method for measuring the resistance of line portions or line lengths in danger signalling systems having the following features:

a multiplicity of detectors (M1 to $M_n$) and other line members, in case of need, which respond to at least one danger criterion and are connected to a two-wire line (line A), a control center connected to the line (line A), which has a voltage supply and a central processor in which the addresses of the detectors (M1 to $M_n$) are stored for individually addressing and polling the detectors (M1 to $M_n$) as well as a program for monitoring the status of the detectors (M1 to $M_n$), characterized by the following process steps:

a testing unit is connected to the line, a testing processor of the testing unit in which the addresses of the detectors (M1 to $M_n$) are stored provides an instruction to a predetermined detector ($M_n$), via its address, to close a cross-connection switch (T3) interconnecting the wires of the line in the detector ($M_n$), a stabilized-current source ($I_{KA}$) of the testing unit (10) generates a stabilized current ($I_A$) on the line, a voltage measuring device measures the voltage drop at the connection of the line and provides the value measured to the testing processor, the testing processor calculates the resistance of the sum of line portions between the connection of the line and the detector ($M_n$) while subtracting the resistances of the detectors (M1 to $M_{n-1}$) and a limiting resistance ($R_{MA}$), if required.

17. The method according to claim 16, characterized in that the resistance or line length between adjoining detectors ($M_n$, $M_2$) is calculated by repeating the steps according to claim 15 for the adjoining detector (M2) and the minor resistance value is subtracted from the major one.

18. The method according to claim 16, characterized in that a timing circuit in the detectors opens the cross-connection switch (T3) after a predetermined time if it had been closed before.

19. The method according to claim 16, characterized in that the resistances or line length of the single line portions between the detectors (M1 to $M_n$) and the predetermined resistance values of the single detectors (M1 to $M_n$) are stored in the testing processor and, when measurements are made in operation later, the resistances measured for the detectors are compared to the resistance values stored for the detectors.

* * * * *